United States Patent [19]

Yokota

[11] Patent Number: 4,551,001

[45] Date of Patent: Nov. 5, 1985

[54] RECORDING APPARATUS USING A RECORDING MEMBER IN ENDLESS BELT FORM

[76] Inventor: Takashi Yokota, No. 29-19, Tamazutsumi 1-chome, Setagaya-ku, Tokyo, Japan

[21] Appl. No.: 515,357

[22] Filed: Jul. 19, 1983

[30] Foreign Application Priority Data

Jul. 20, 1982 [JP] Japan ..... 57-125133

[51] Int. Cl.[4] ..... G03G 15/00

[52] U.S. Cl. ..... 355/3 BE; 355/3 R; 355/16

[58] Field of Search ..... 355/16, 3 R, 3 BE

[56] References Cited

U.S. PATENT DOCUMENTS 4,429,985 2/1984 Yokota ..... 355/16 X 4,470,690 9/1984 Hoffman ..... 355/16 X

*Primary Examiner*—A. C. Prescott

*Attorney, Agent, or Firm*—Guy W. Shoup

[57] ABSTRACT

A recording apparatus including a recording member in the form of an endless belt trained over a plurality of rollers which are rotated to drive the recording member. The recording member can be selectively moved between a position in which it is tensioned and a position in which tension is removed therefrom, and a recording member unit of which the recording member is not tensioned is prevented from being placed in a predetermined position in the recording apparatus when an attempt is made to lead such recording member unit on the recording apparatus.

2 Claims, 16 Drawing Figures

RECORDING APPARATUS USING A RECORDING MEMBER IN ENDLESS BELT FORM

FIELD OF THE INVENTION

This invention relates to a recording apparatus using a recording member in the form of an endless belt comprising a recording member unit including a plurality of rollers for supporting and driving the recording member in the form of an endless belt trained thereon, and a support member for supporting the rollers at opposite ends for rotation, and housing means for containing the recording member unit.

DESCRIPTION OF THE PRIOR ART

Figure 1:
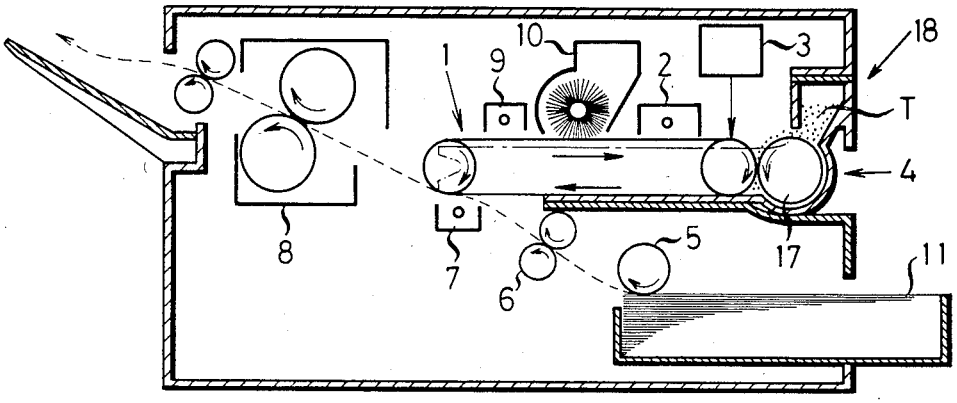
FIG. 1 PRIOR ART
FIG. 1 is a sectional side view of a recording apparatus in which the present invention can be incorporated.

One type of recording apparatus of the prior art is shown in FIG. 1. The recording apparatus comprises a recording member unit 1, a charger unit 2, a exposure device 3, a developer unit 4, a feed roller 5, a pair of register rollers 6, transfer-printing charger unit 7, a fixing member 8, a charge removing unit 9, a cleaning device 10 and a recording sheet 11.

Figure 2:
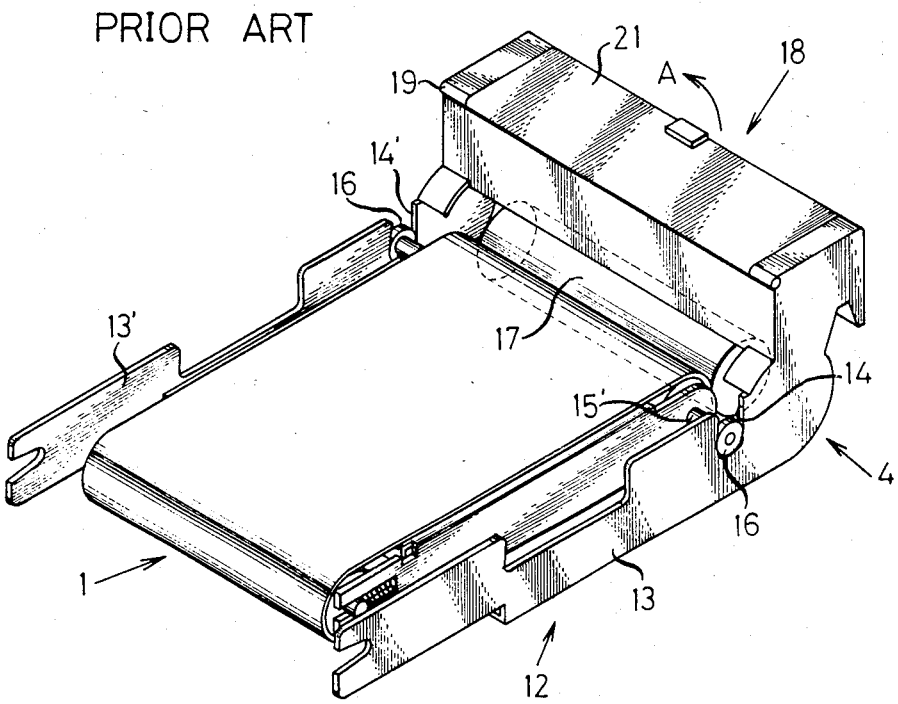
FIG. 2 PRIOR ART
FIG. 2 is a perspective view of a recording member unit of the prior art contained in the developer unit shown in FIG. 1.

Referring to FIG. 2, the recording member unit 1 is housed in a housing section 12 of the developer unit 4. The housing section 12 includes side plates 13 and 13' formed in portions thereof near a body of the developer unit 4 with notches 14 and 14' respectively for supporting a shaft 15' of one roller of the recording medium unit through bearing 16. The numeral 17 designates a developing sleeve, and the numeral 18 designates a toner tank disposed above the developing sleeve 17. A cover 21 is hingedly connected at 19 to an upper portion of the toner tank 18. When an additional supply of toner T is filled in the toner tank 18, the cover 21 is pivotally moved in the direction of an arrow A shown in FIG. 2.

Figure 3:
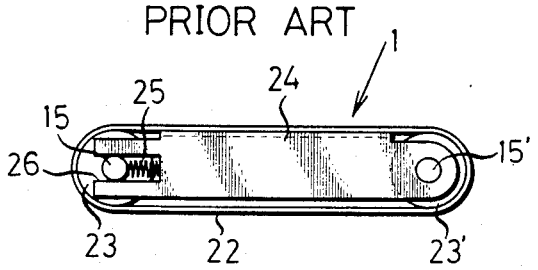
FIG. 3 PRIOR ART
FIG. 3 is a side view of the recording medium unit of the prior art shown in FIG. 1.

FIG. 3 shows the recording member unit 1 of the prior art. As shown, the recording medium unit 1 comprises a recording member 22 in the form of an endless belt, a pair of feed rollers 23 and 23', a cassette frame 24 and compression coil springs 25, the recording member 22 being trained over the feed rollers 23 and 23' and supported thereon. Shafts 15 and 15' of the rollers 23 and 23' respectively are supported by the cassette frame 24. More specifically, the shaft 15' of one of the rollers 23 and 23' or the drive roller 23' is supported at one end portion of the cassette frame 24 and the shaft 15 of the other roller 23 or the follower roller 23 is movably engaged in cutouts 26 at other end portion of the cassette frame 24. The shaft 15 of the roller 23 is urged by the biasing forces of the compression coil springs 25 each mounted at the base of one of the cutouts 26 to impart a tension to the recording member 22.

Some disadvantages are associated with this type of recording member unit. When the recording member unit 1 is not loaded on a recording apparatus yet (when being transported or kept in storage), the spring 25 impart tension of the recording member 22 which is not necessary. Because of this, when the rollers 23 and 23' have a small diameter which is often the case, the recording member 22 might suffer undesirable deformation. Prolonged holding of the recording member 22 under tension in poor environmental conditions (high temperature, high humidity, etc.) during transportation or storage might cause the recording member 22 to be stretched, to develop surface cracks or to be deteriorated in characteristics.

SUMMARY OF THE INVENTION

This invention has been developed for the purpose of obviating the aforesaid disadvantages of the prior art. Accordingly the invention has as one of its objects the provision of a recording apparatus in which undesirable deformation or deterioration of characteristics difficulty occur in the recording member in the form of an endless belt.

Another object is to provide a recording apparatus including a recording member in the form of an endless belt capable of driving the recording member under satisfactory conditions at all times.

The aforesaid first object is accomplished according to the invention by moving at least one roller away from other rollers by means of a biasing member during normal operation of the recording apparatus to thereby impart tension to the recording member and by allowing the one roller urged by the biasing member to move away from the other rollers during normal operation of the recording apparatus to move toward the other rollers by tension releasing means against the biasing force of the biasing member to thereby release tension from the recording member when the recording apparatus is left in inoperative condition for a prolonged period of time.

The aforesaid second object is accomplished according to the invention by providing the tension releasing means with a displacing member changing its position when the recording member moves from a position in which it is tensioned to a position in which tension is released therefrom and by providing the housing means for housing the recording member unit with a housing regulating member which is not engageable with the displacing member in the position to which it moves when the recording member is tensioned and which is engageable with the displacing member in the position to which it moves when tension is released from the recording member, whereby the recording member unit is prevented from being housed in the housing means when tension is released from the recording member because the housing regulating member is in engagement with the displacing member.

DESCRIPTION OF THE PREFERRED EMBODIMENTS

Figure 4:
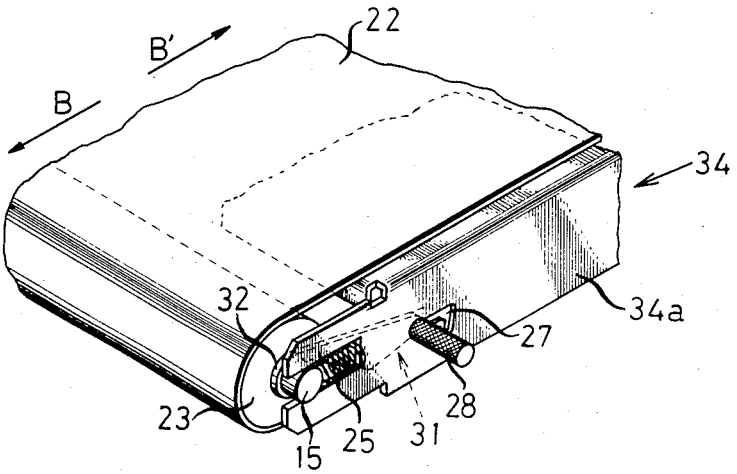
FIG. 4 is a perspective view of the essential portions of the recording member unit comprising one embodiment of the invention.
Figure 5:
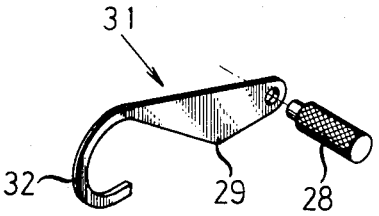
FIG. 5 is an exploded perspective view of the recording medium unit shown in FIG. 4.

FIG. 4 is a perspective view of the essential portions of one embodiment of the recording member unit in conformity with the invention, in which parts similar to those of the recording member unit of the prior art shown in FIG. 3 are designated by like reference characters. As shown, a cassette frame 34 includes a side plate 34*a* formed with a guide slot 27 substantially in the form of a letter L through which a knob 28 extends outwardly from the cassette frame 24. As shown in FIG. 5, the knob 28 is screwed to one end portion of an arm 29 formed of thin metal sheet to constitute a release arm 31, and a curved portion 32 formed at the other end portion of the arm 29 engages the shaft 15 of the roller 23 shown in FIG. 4. In FIG. 4, the roller 23 is shown as being urged by the biasing force of a compression spring 25 to move in the direction of an arrow B through the shaft 15, to thereby impact tension to the recording member 22 in the form of an endless belt. The recording member 22 will hereinafter be described as being in a tensioned condition. If the knob 28 is moved in the direction of an arrow B′ along the guide slot 27 from its position shown in FIG. 4, then the release arm 31 moves as a whole in the same direction against the biasing force of the spring 25 and the roller 23 also moves in the direction of the arrow B′, to thereby gradually release tension from the recording member 22.

Figure 6:
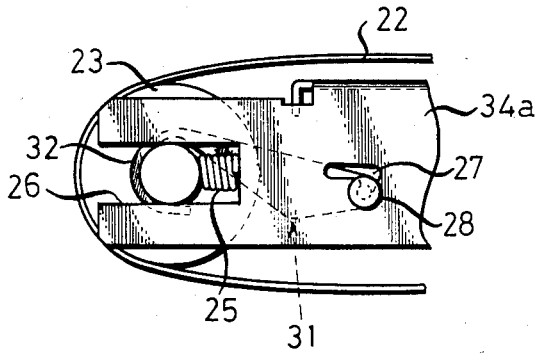
FIG. 6 is a view showing the recording member of the recording member unit shown in FIG. 4, showing the recording member in a condition in which tension is released therefrom.

FIG. 6 shows the knob 23 moved downwardly into a short leg portion of the substantially L-shaped guide slot 27 after reaching the end of its movement in the direction of the arrow B′. When the knob 28 is in this position, the release ram 31 is prevented from returning to the condition shown in FIG. 4 in which the recording member 22 is tensioned. Stated differently, the recording member 22 is maintained in a condition in which tension is release therefrom. When it is desired to bring the recording member 22 to the tensioned condition, one only has to move the knob 28 into a long leg portion of the guide slot 27. Once the knob 28 is moved to the long leg portion of the guide slot 27, the recording member 22 is automatically moved by the biasing force of the spring 25 to the tensioned condition.

As described hereinabove, the recording member 22 can be moved between the tensioned condition and the condition in which tension is removed from the recording member 22 merely by manipulating the knob 28 of the release arm 31. Thus it is possible to bring the recording member 22 to the tensioned condition when it is put to use and bring same to the condition in which tension is removed from the recording member 22 when it is rendered inoperative for a prolonged period of time, to thereby avoid troubles, such as deformation of the recording member 22, deterioration of its characteristics, etc. The feature that the recording member 22 can be moved between the two conditions or the condition in which it is tensioned and the condition in which tension is removed therefrom enables the aforesaid advantages to be achieved. However, if the recording member unit 1 is inadvertently inserted in the housing section 12 of the developer unit 4 of a recording apparatus by inadvertently keeping the recording member 22 in the condition in which tension is released therefrom and if the recording apparatus is operated while the recording member 22 is not tensioned, recording of information will not only be impossible to perform but also the recording member unit 1 itself will suffer damage.

Figure 7:
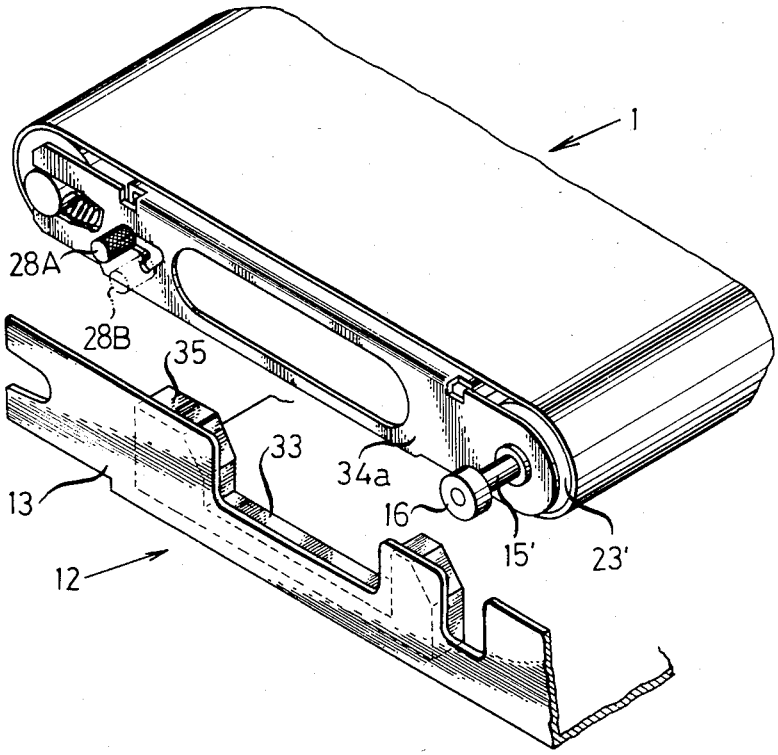
FIG. 7 is a perspective view of the same recording member unit as shown in FIG. 4 and the housing section according to the invention for housing the recording member of the recording member unit.
Figure 8:
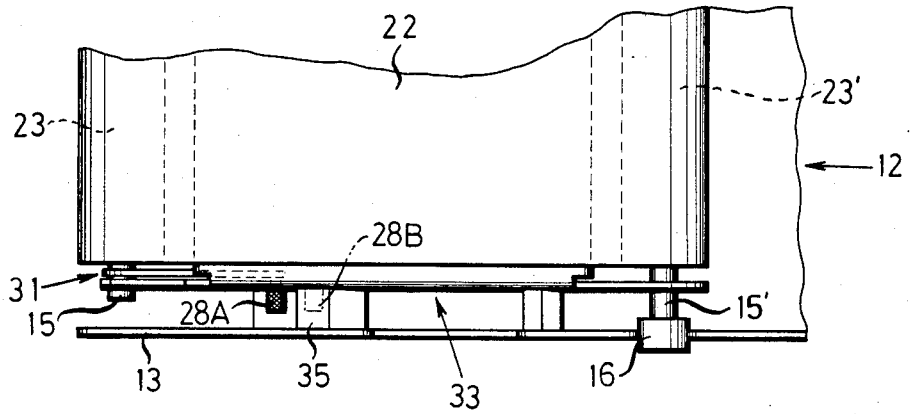
FIG. 8 is a top plan view of the recording member unit housed in the housing section according to the invention shown in FIG. 7.

In the embodiment shown and described hereinabove, means is provided as follows to cope with the aforesaid situation by utilizing the knob 28 of the release arm 31 which changes its position when the recording member 22 is moved between the tensioned condition and the condition in which tension is removed. More specifically, FIG. 7 shows a recording member unit regulator 33 secured to an inner surface of the side plate 13 of the housing section 12 of the developer unit 4 (FIG. 2). The recording member unit regulator 33 includes a housing regulating portion 35 located in its forward end portion in such a manner that, as shown in FIG. 8, it does not engage the knob (28A shown in solid lines) when the recording member 22 is in the tensioned condition and it engages the knob (28B in broken lines) when the recording member is in the condition in which tension is removed therefrom. By this arrangement, the recording member unit 1 is prevented from being inserted in the housing section 12 even if an attempt is made to load same on a recording apparatus when the recording member 22 is in the condition in which tension is removed therefrom, because the knob 28B engages the housing regulating portion 35. The operator is able to find that the recording member 22 is not in the tensioned condition by sensing the engagement of the housing regulating portion 35 with the knob 28B.

Alternatively if means is provided for indicating that the recording apparatus is not fit for starting operation when the recording member unit 1 is not placed correctly in the housing section 12, it is possible to render the recording apparatus inoperative unless the recording member 22 is in the tensioned condition. Such means may comprise sensing means which senses whether or not the cassette frame 34 is fully inserted in the housing section 12.

FIGS. 9–12 show another embodiment of the invention which will be described by referring to the drawings.

Figure 9:
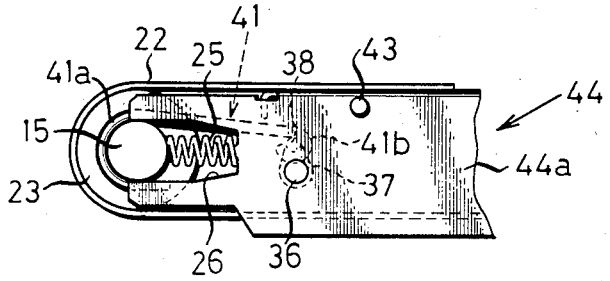
FIG. 9 is a sectional side view of the essential portions of the recording member unit comprising another embodiment.

In FIG. 9, the roller shaft 15 fitted in a notch 26 formed at a side plate 44*a* of a cassette frame 44 serving as a support member is urged by the biasing force of the spring 25 to move leftwardly in the figure to thereby move the roller in the same direction. The roller 23 moved leftwardly by the spring 25 brings the recording member 22 in the form of an endless belt to the tensioned condition. A curved portion 41*a* at one end of a tension release arm 41 locks the roller shaft 15 in position, and another curved portion 41*b* smaller than the curved portion 41*a* is formed at the other end of the arm 41 to engage a pin 38 secured to a forward end of a pivotable arm 37 projecting radially from a rotary shaft 36.

Figure 10:
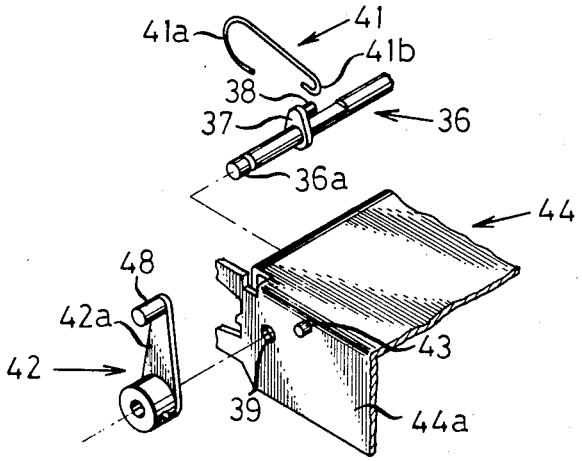
FIG. 10 is an exploded perspective view of the rotary shaft and other parts shown in FIG. 9.

Referring to FIG. 10,the rotary shaft 36 is supported in an aperture 39 formed in the side plate 44*a* of the cassette frame 44 and extends outwardly therefrom at an end portion 36*a*. FIG. 10 showns only one end portion of the rotary shaft 36 supported in the aperture 39. It is to be understood that the rotary shaft 36 is also supported at the other end portion in like manner, except that the rotary shaft need not extend outwardly from the side plate. Also, FIG. 10 only shows one set of pivotable arm 37 extending radially from the shaft 36, pin 38 at the forward end of the arm 37 and tension release arm 41 engageable with the pin 38. It is to be understood, however, that another set of these members is arranged on the other side plate of the cassette frame 44, not shown, and the tension release arm of this set is brought into locking engagement with the shaft 15 at a portion thereof supported by the other side plate of the cassette frame and functions in the same manner as described by referring to the arm 41 shown in FIGS. 9 and 10. Thus the operation of the arm 41 shown in the drawings will only be described.

A lever 42 is attached to the shaft end portion 36*a* of the shaft 36 extending outwardly from the cassette frame 44 through the aperture 39. The lever 42 includes an arm 42*a* having a knob 48 secured to its forward end. If the operator grips the knob 48 and turns the lever 42, the shaft 36 then rotates through an angle corresponding to the angle through which the lever 42 is turned.

Figure 11:
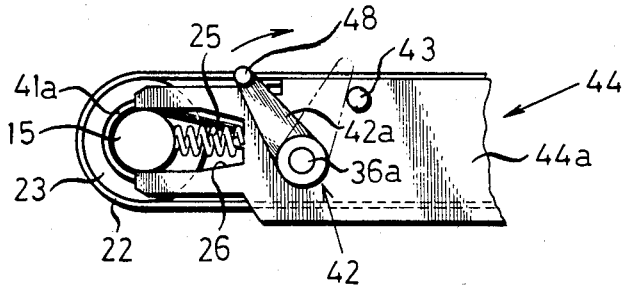
FIG. 11 is a side view of the recording member unit shown in FIG. 9, showing the manner in which the lever shown in FIG. 10 is operated.
Figure 12:
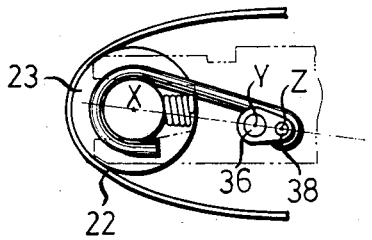
FIG. 12 is a view of the recording member unit shown in FIG. 9, showing the recording member of the recording member unit in a condition in which tension is released therefrom.

When the recording member 22 is in the tensioned condition as shown in FIG. 9 in which the lever 42 is not shown, the lever 42 is pivoted toward the roller 23 as shown in solid lines in FIG. 11. If the lever 42 is turned in the direction of an arrow from the position shown in FIG. 11, then the pivotable arm 37 shown in FIG. 9 moves in pivotal movement in a clockwise direction about the shaft 36 in FIG. 9. The pin 38 pivotally moving with the arm 37 moves the tension release arm 41 rightwardly in the figure, to allow the roller 23 to move rightwardly against the biasing force of the spring 25. The movement of the roller 23 gradually releases tension from the recording member 22. When the lever 42 has moved to a position in which it abuts against a stopper 43 secured to the side plate 44*a* as shown in dash-and-dot lines in FIG. 11, the center axis X of the roller 23, the center axis Y of the rotary shaft 36 and the center Z of the pin 38 are connected together by a straight line or the center of the pin 38 is located below a straight line connecting the center axes X and Y of the roller 23 and rotary shaft 36 together. Thus the lever 42 is held in a position in which the arm 42*a* abuts against the stopper 43, to thereby release tension from the recording member 22.

As described hereinabove, the recording member 22 in the form of an endless belt of this embodiment can be selectively moved to one of the tensioned condition and the condition in which tension is removed from the recording member 22, merely by turning the knob 48 to move the lever 42 in pivotal movement. Thus if the operator moves the recording member 22 to the tensioned condition when it is desired to use the recording member 22 and moves same to the condition in which tension is released from the recording member 22 when it is not used, it is possible to avoid the occurrence of deformation and deterioration of characteristics in the recording member 22.

When the roller 23 is moved to release tension from the recording member 22, two tension release arms are actuated as described hereinabove. These arms are simultaneously moved when one lever 42 provided to one side plate of the cassette frame 44 is operated, thereby simplifying the construction and operation. By providing one tension release arm to each end portion of the roller shaft as described by referring to the embodiment shown in FIGS. 9, 10 and 11, the roller 23 can be positively supported. However, it is not essential to provide two tension release arms, one for each end portion of the roller shaft, and according to the invention only one tension release arm may be provided to one end portion of the roller shaft. In this case, it would be necessary to arrange the tension release arm in the axial center position of the roller 23 or to increase the area in which the tension release arm engages the roller 23.

The length of the arm 42*a* of the lever 42 may be increased to thereby increase the interval between the shaft 36 and the knob 48. This will apparently make it possible to effect release of tension from the recording member 22 with a small force.

In the embodiment of the invention shown in FIGS. 9–11, the knob 48 of the lever 42 changes its position when the recording member 22 moves between the tensioned position and the position in which, tension is released from the recording member 22, like the knob 28 of the arm 31 of the embodiment shown in FIGS. 4–8. By utilizing this change in the position of the knob 48, it is possible to avoid the recording member unit 1 being inserted in the housing section 12 (FIG. 7) of the developer unit 4 when the recording member 22 is not in the tensioned condition, in the same manner as described by referring to the embodiment shown in FIGS. 4–8. The housing section 12 may be of the same construction as that shown in FIGS. 4–8.

Figure 13:
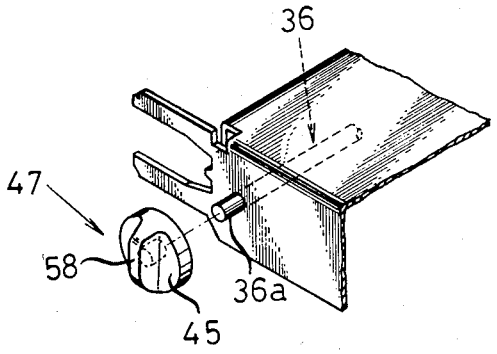
FIG. 13 is an exploded perspective view of the essential portions of the recording member unit comprising still another embodiment.
Figure 14A:
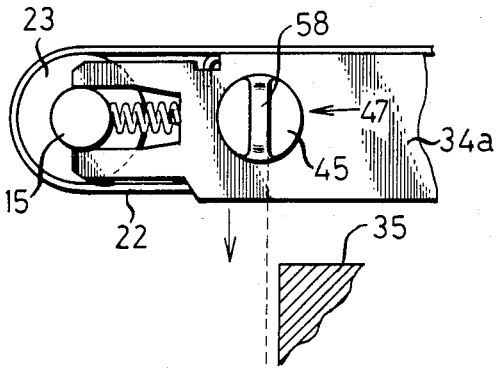
FIGS. 14*a* and 14*b* are side views of the recording unit shown in FIG. 13, showing the recording member of the recording member unit in a condition in which tension is released therefrom.
Figure 14B:
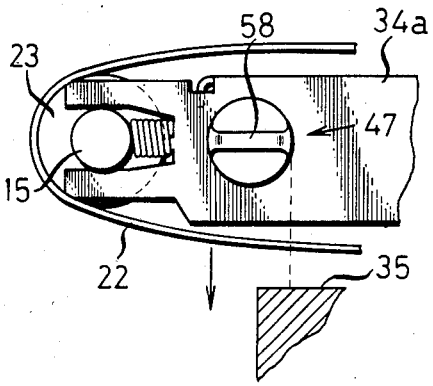

FIG. 13 shows in a perspective view the essential portions of still another embodiment of the invention. In this embodiment, the end portion 36*a* of the rotary shaft 36 has attached thereto a knob 47 including a base 45 of substantially circular shape, and a body 58 connected to the base 45 in a position extending radially of the base 45 and extending outwardly at a right angle thereto. The knob 47 is connected to the end portion 36*a* of the shaft 36 in such a manner that, when the recording member 22 is in the tensioned condition, the body 58 of the knob 47 is in a vertical position as shown in FIG. 14*a* and, when the recording member 22 is not in the tensioned position, the body 58 is in a horizontal position as shown in FIG. 14*b*. By arranging the housing regulating portion 35 of the housing section 12 for housing the recording member unit 1 (see FIG. 7) in such a manner that the regulating portion 35 is not brought into engagement with the body 58 of the knob 47 when the recording member 22 is in the tensioned condition (FIG. 14*a*) and brought into engagement with the body 58 when it is not in the tensioned condition (FIG. 14*b*), it is possible to avoid the trouble of the recording member unit 1 being inserted in the housing section 12 when the recording member 22 is not in the tensioned condition.

In all the three embodiments shown and described hereinabove, the recording member unit 1 is prevented from being inserted in the housing section 12 when the recording member 22 is not in the tensioned condition by a displacing member which changes its position when the recording member 22 moves between the tensioned position and the position in which tension is removed from the recording member 22. Such displacing member comprises the knob 28 (FIG. 7) of the first embodiment, the knob 48 (FIG. 11) of the second embodiment and the knob 47 (FIG. 47) of the third embodiment.

Figure 15:
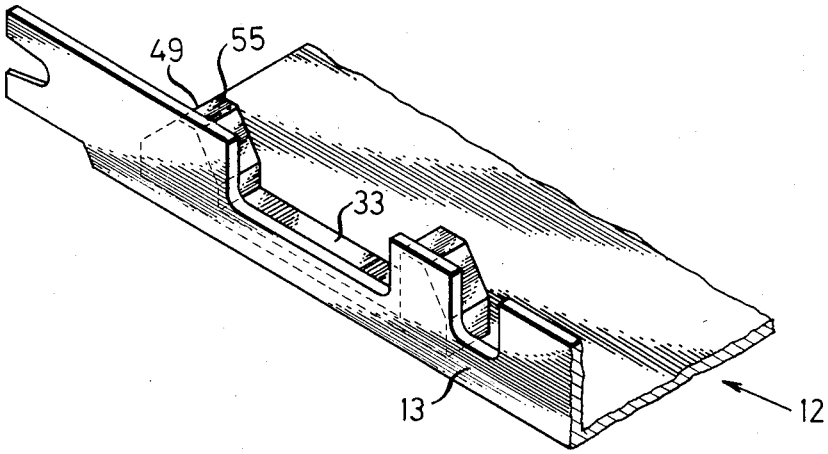
FIG. 15 is a perspective view of a modification of the housing regulating portion.

FIG. 15 shows a modification of the housing regulating portion 35. As shown, the portion 55 has an inclined guide surface 49 at its forward end. The provision of the inclined guide surface 49 has the following effect. Assume that the recording member unit 1 inserted in the housing section 12 includes a recording member 22 which is not in the tensioned condition. In this case, if the recording member unit 1 is forcedly inserted in the housing section 12, then the knob 28 (FIG. 7), which is initially in a position which corresponds to the position of the recording member 22 in which tension is removed therefrom, is gradually forced to move along the guide surface 49 to a position which corresponds to the tensioned position of the recording member 22, until finally the recording member 22 is moved to the tensioned position when the recording member unit 1 is fully inserted in the housing section 12. That is, the provision of the guide surface 49 enables the recording member 22 to be moved to the tensioned position upon completion of insertion of the recording member unit 1 into the housing section 12 regardless of the position of the recording member 22 in the recording member unit 1 being inserted in the housing section 12, thereby precluding any trouble that might otherwise occur in the operation of the recording apparatus due to the recording member 22 not being in the tensioned condition.

In the embodiments shown and described hereinabove, the housing regulating portion for engaging the displacing member comprises the housing regulating portion 35, 55; located in the forward end portion of the recording member unit regulating member 33. It is to be understood that the housing regulating member 35, 55 may be an entity separate from and independent of the recording member unit regulating member 33.

In the embodiments shown and described hereinabove, the displacing member has been described as being a knob. The invention is not limited to this specific form of the displacing member and any element or member may be used as a displacing member so long as it changes its position when the recording member moves between the tensioned position and the position in which tension is released from the recording member.

What is claimed is:

1. In a recording apparatus including a housing, a recording member unit in the form of an endless photoconductive belt, a plurality of rollers supported releasably in said housing and on which said belt is entrained and guided, biasing means for biasing at least one roller away from the others to tension said belt, tension releasing means in the form of a manually actuable grip for releasing the biasing means, the improvement wherein said housing includes a stopper portion which engages said manual grip when it is attempted to insert said recording member unit in said housing in a condition where the biasing means is released, whereby the recording member unit is prevented from being inserted into said housing in said condition.

2. The recording apparatus of claim 1, wherein said stopper portion includes a guide surface for moving the manual grip to a biasing position to tension said belt when said recording member unit is inserted in said housing in said condition.

* * * * *